United States Patent [19]

Dolman et al.

[11] Patent Number: 4,648,186

[45] Date of Patent: Mar. 10, 1987

[54] METHOD OF PREVENTING MOISTURE ACCUMULATION AND MILDEW

[76] Inventors: James Dolman; Gerri Dolman, both of Rte. 1, Box 354, Cashmere, Wash. 98815

[21] Appl. No.: 734,180

[22] Filed: May 15, 1985

[51] Int. Cl.[4] ..... F26B 5/16

[52] U.S. Cl. ..... 34/9; 34/71; 34/95; 5/484; 5/448

[58] Field of Search ..... 34/9, 14, 71, 95, 80, 34/81; 5/448, 473, 482, 484; 312/31.01

[56] References Cited

U.S. PATENT DOCUMENTS

| | | | |
|---|---|---|---|
| 836,438 | 11/1906 | Coey | 34/95 |
| 2,210,862 | 8/1940 | Tronstad | 34/95 |
| 2,533,088 | 12/1950 | Brewer et al. | 312/31.01 |
| 2,713,214 | 7/1955 | Gulaskie | 34/95 |
| 4,173,046 | 11/1979 | Gallagher | 5/484 |

*Primary Examiner*—Albert J. Makay
*Assistant Examiner*—David W. Westphal
*Attorney, Agent, or Firm*—Lane and Aitken

[57] ABSTRACT

A water absorbant sheet, consisting essentially of wood pulp cellulose fiber and no more 15% by weight of water, is used to maintain problem areas particularly in marine and recreational vehicle applications, dry and to prevent mildew. Bedding is maintained dry by cutting the sheets to a size to conform to the bedding and placed under the bedding. The sheets can also be used to maintain cushions dry in a similar manner. After cutting the sheets to conform to the inside dimensions of a drawer, the sheets may be placed in the drawer to maintain the contents of the drawer dry. The sheets can also be cut to size and be placed on cupboard shelves to maintain cupboards dry.

13 Claims, 1 Drawing Figure

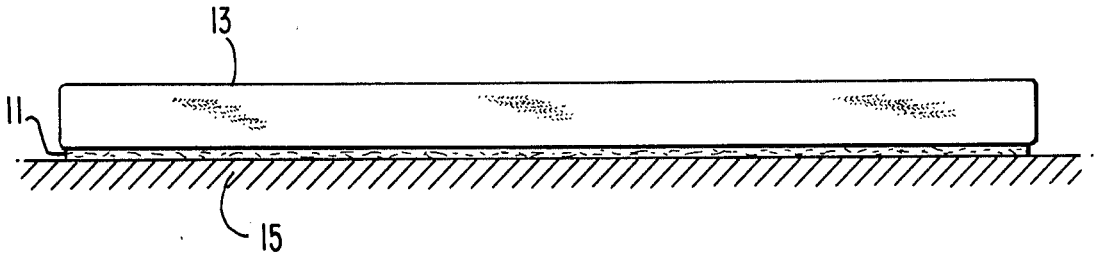
13
11
15

METHOD OF PREVENTING MOISTURE ACCUMULATION AND MILDEW

This invention relates to a method of maintaining bedding dry and preventing mildew, particularly in marine, boating and recreational vehicle applications.

A persistent problem in watercraft of the type designed for overnight accommodations, such as pleasure boats in particular, is to maintain the beds or bunks of the watercraft dry and prevent mildew. Various products could be used as a desiccant to absorb moisture from the bedding and prevent moisture accumulation, but most available products do not provide a satisfactory solution to the problem, either because they are ineffective or the desiccant materials are inconvenient to install or replace.

The present invention provides a very effective method of maintaining marine bedding dry and preventing mildew, which method is also convenient to use. In accordance with the invention, a mat, which is made of a highly moisture absorbant material is cut to conform to the size of the mattress or bedding and is placed under the mattress or bedding. The mat is a sheet about 1 mm thick formed from wood pulp cellulose fiber. The wood pulp sheet has about the same stiffness and flexibility as a sheet of carboard of the same thickness, so that it is easily handled and will lay flat automatically when installed without need for smoothing. Elevation of the cushions or matress after usage for a period of time results in air drying of the mat in place so that the mat continues to be usable. The wood pulp sheet is so highly absorbant that it will absorb over three times its weight in water when in place. After the sheet has absorbed water, the sheet will store the absorbed water away from the bunk and because of the sheet's high affinity for water, it will not itself become a source of dampness to the bedding even after it has been in place and has absorbed a considerable amount of moisture. Because the wood pulp is in sheet form and has sufficient stiffness to lie flat automatically without smoothing, it can be installed or replaced with less effort than it takes to change the sheets on the bunk. Because of the sheet's flexibility, it readily conforms to the shape of the underlying supporting surface of the bunk and will not interfere with the comfort provided by any resiliency designed into this underlying surface, such as a surface defined by a bed spring.

Accordingly, an object of the invention is to provide an improved method of maintaining bedding dry and preventing mildew.

A further object of this invention is to provide an improved method of maintaining bunks on watercraft dry and preventing mildew.

Further objects and advantages of the present invention will become readily apparent as the following detailed description of the invention unfolds and when taken into conjunction with the drawings.

BRIEF DESCRIPTION OF THE DRAWING

The single FIGURE of the drawing schematically illustrates a bunk with the absorbant sheet placed beneath the mattress of the bunk in accordance with the present invention.

DESCRIPTION OF A PREFERRED EMBODIMENT

In accordance with the invention, highly absorbant sheets of wood pulp cellulose fiber, are provided in sizes of variable width with the standard size being 16"×120". The sheets are cut to conform to the size and shape of the bedding to be kept dry and are placed under the bedding, preferably in direct contact therewith, where the sheet of wood pulp fiber will absorb moisture from the bedding. The single figure of the drawing shows a sheet 11 of wood pulp cellulose fiber placed under a mattress 13 on a bunk support 15 as might be found on a pleasure boat or recreational vehicle, in accordance with the present invention.

The water absorbant sheet employed in the invention consists essentially of wood pulp cellulose fiber and water, which has been thoroughly dried to reduce the amount of water in the sheet to a minimum. The sheet should have a thickness of about 0.5 mm to 3 mm and preferably has a thickness of about 1 mm and has a density so that it weighs about 200 grams per square meter. The thickness of the sheet is selected to meet several objectives. The sheet should be thin enough to have sufficient strength so that it will not readily come apart in use and will dry rapidly. Also, it should be sufficiently rigid to hold its shape under its own weight in relatively small pieces, such as 1 square foot and yet be sufficiently flexible to conform generally to the shape of an underlying supporting surface under a mattress supporting the weight of a person. The sheet is designed to be sufficiently water absorbant so that in use, it will absorb over three times its weight in water. After the sheet has become laden with water the cushions or mattress are elevated to allow drying of the absorbant mat in place by air circulation over the mat and that mat may then be reused after drying by simply replacing the cushions or mattress back on the mat.

A preferred example of a wood pulp cellulose fiber sheet, which can be used in the method of the invention is manufactured by Weyerhaeuser Company and marketed under the name Glade-K. This sheet, which is made from Douglas Fir wood chips contains no more than 15% by weight of water and has a water absorbancy capability of 6½ times its original weight. An alternative sheet, which can be used in the method is the wood pulp cellulose fiber sheet manufactured by Weyerhaeuser and marketed under the name Glade-S. A third alternative sheet, which can be used in the method, is the wood pulp cellulose fiber sheet manufactured by Weyerhaeuser and marketed under the name A.A. Sulfide.

The wood pulp cellulose fiber sheets employed in the method of the invention, are manufactured by refining wood chips by the kraft process to produce bleached separated cellulose fibers essentially free from lignin, which bonds the fibers together in the wood chips. A slurry of the fibers is fed onto a travelling wire screen of the fourdrinier type to form a continuous sheet of the wood pulp fiber. The sheet of pulp is carried over several suction boxes and presses and a Minton vacuum dryer to remove water from the sheet and form the sheet into a web of uniform thickness, which has been thoroughly dried to reduce the water in the sheet to a minimum. The resulting sheet is the wood pulp cellulose fiber sheet employed in the present invention.

In addition to maintaining mattresses and bedding dry, the wood pulp sheets may be used in a similar manner to maintain the dryness of cushions, by being cut to a size and shape to conform to the cushion and then placed under or behind the cushion in direct contact therewith. In addition, the sheets may be cut and shaped to correspond with the inside dimensions of a drawer and placed in the bottom of the drawer to maintain the contents of the drawer in a dry condition. Also, the sheets may be cut to conform in size and shape to the shelves in a cupboard and placed on the shelves to maintain the contents of the cupboard in a dry condition. The material can be utilized wherever condensation is evident.

Because of the high absorbancy of the sheet and the facility with which it can be used and reused, the method of the invention provides an improved, convenient method of maintaining a dry environment in problem areas, such as the bedding of bunks on pleasure boats, recreational vehicles and other watercraft. The description is of a preferred embodiment of the invention and modifications may be made thereto without departing from the spirit and scope of the invention, which is defined in the appended claims.

In the claims:

1. A method of maintaining bedding of a type susceptible to moisture accumulation and mildew in a dry condition comprising providing a moisture absorbant sheet made of wood pulp unmodified cellulose fiber and formed into said sheet directly from wood pulp, cutting said sheet to conform to the size and shape of the bedding to be kept dry, and placing said sheet under said bedding in direct contact with said bedding to absorb moisture from said bedding.

2. A method as recited in claim 1, wherein said bedding comprises a mattress.

3. A method as recited in claim 1, wherein said sheet is at least 0.5 mm thick.

4. A method as recited in claim 1, wherein said sheet contains no more than 15% by weight of water when placed under said bedding.

5. A method as recited in claim 1, wherein said sheet has a thickness of between 0.5 mm and 3 mm.

6. A method as recited in claim 1, wherein said sheet has a thickness of about 1 mm.

7. A method as recited in claim 6, wherein said sheet has a density so that it weighs about 200 grams per square meter of said sheet.

8. A method as recited in claim 1, wherein said sheet will absorb over 3 times its weight in moisture.

9. A method as recited in claim 1, wherein said sheet will absorb about 6½ times its weight in moisture.

10. A method as recited in claim 1, wherein said sheet consists essentially of wood pulp cellulose fiber and water with no more than 15% by weight of water.

11. A method of maintaining a cushion in a dry condition comprising providing a sheet of made unmodified cellulose fiber and formed in said sheet directly from wood pulp, cutting said sheet to conform to the size of said cushion and placing said sheet behind said cushion in contact therewith.

12. A method of maintaining the contents of drawer in a dry condition comprising providing a sheet made of unmodified cellulose fiber and formed in said sheet directly from wood pulp, cutting said sheet to conform to the inside dimension of said drawer, and placing said sheet in the bottom of said drawer.

13. A method of maintaining bedding of type susceptible to moisture accumulation and mildew in a dry condition, comprising providing a moisture absorbant sheet made of unmodified cellulose fiber and formed into said sheet directly from wood pulp, cutting said sheet to conform to the size and shape of the bedding to be kept dry, placing said sheet under said bedding to absorb moisture from said bedding, and raising said bedding from said sheet after said sheet has become laden with moisture to allow said sheet to dry by air circulation over said sheet, and then after said sheet has been dried, replacing said bedding on said sheet.

* * * * *